US006266857B1

(12) United States Patent
Corbett, III et al.

(10) Patent No.: US 6,266,857 B1
(45) **Date of Patent: *Jul. 31, 2001**

(54) METHOD OF PRODUCING A BACKING STRUCTURE FOR AN ULTRASOUND TRANSCEIVER

(75) Inventors: Scott S. Corbett, III, Portland, OR (US); Jeffery Alan Strole, Ellensburg, WA (US)

(73) Assignee: MicroSound Systems, Inc., Snoqualmie, WA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/024,843

(22) Filed: Feb. 17, 1998

(51) Int. Cl.[7] ..... H04R 17/00

(52) U.S. Cl. ..... 29/25.35; 29/594; 29/846; 367/155; 310/367

(58) Field of Search ..... 29/25.35, 594, 29/846; 219/121.85; 367/155, 140; 310/344, 366, 367, 336

(56) References Cited

U.S. PATENT DOCUMENTS

| | | | | |
|---|---|---|---|---|
| 3,995,179 | | 11/1976 | Flournoy et al. | 310/8.2 |
| 4,434,384 | | 2/1984 | Dunnrowicz et al. | 310/325 |
| 4,611,372 | | 9/1986 | Enjoji et al. | 29/25.35 |
| 4,616,152 | | 10/1986 | Saito et al. | 310/334 |
| 4,747,192 | | 5/1988 | Rokurota | 29/25.35 |
| 4,751,420 | | 6/1988 | Gebhardt et al. | 310/327 |
| 5,267,221 | | 11/1993 | Miller | 367/140 |
| 5,288,007 | * | 2/1994 | Interrante et al. | 228/119 |
| 5,297,553 | | 3/1994 | Sliwa, Jr. et al. | 128/662.03 |
| 5,329,496 | * | 7/1994 | Smith | 367/140 |
| 5,329,498 | | 7/1994 | Greenstein | 367/155 |
| 5,381,385 | * | 1/1995 | Greenstein | 367/155 |
| 5,457,863 | * | 10/1995 | Thomas et al. | 29/25.35 |
| 5,493,541 | | 2/1996 | Snyder | 367/155 |
| 5,559,388 | * | 9/1996 | Lorraine et al. | 310/344 |
| 5,592,730 | | 1/1997 | Greenstein et al. | 29/594 |
| 5,612,511 | * | 3/1997 | Meyer et al. | 174/254 |
| 5,614,114 | * | 3/1997 | Owen | 219/121.85 |
| 5,629,906 | | 5/1997 | Sudol et al. | 367/162 |
| 5,644,085 | | 7/1997 | Lorraine et al. | 73/641 |
| 5,648,941 | | 7/1997 | King | 367/176 |
| 5,648,942 | | 7/1997 | Kunkel, III | 367/176 |
| 5,742,026 | * | 4/1998 | Dickenson et al. | 219/121.85 |
| 5,743,006 | * | 4/1998 | Beratan | 29/25.35 |
| 5,758,396 | * | 6/1998 | Jeon et al. | 29/25.35 |
| 5,855,049 | * | 1/1999 | Corbett et al. | 29/25.35 |

FOREIGN PATENT DOCUMENTS

| | | | | |
|---|---|---|---|---|
| 58-139511 | * | 8/1983 | (JP) | 29/25.35 |
| 61-24315 | * | 2/1986 | (JP) | 29/25.35 |

* cited by examiner

*Primary Examiner*—Lee Young
*Assistant Examiner*—A. Dexter Tugbang
(74) *Attorney, Agent, or Firm*—Timothy E. Siegel

(57) ABSTRACT

A method of producing an acoustically absorbing anisotropic backing structure for an ultrasound transceiver is disclosed. Laser machining of a substrate of acoustically absorbent electrically resistive material produces a set of vias and indented pad seats. The machined substrate is plated with an electrically conductive material. Excess electrically conductive material is removed from the substrate to leave an electrically conductive material plating on the indented pad seats and the vias to form conductive pads and plated vias on the substrate.

12 Claims, 10 Drawing Sheets

METHOD OF PRODUCING A BACKING STRUCTURE FOR AN ULTRASOUND TRANSCEIVER

BACKGROUND OF THE INVENTION

The present invention is a process for producing an acoustically absorbing backing structure for an ultrasound transceiver and the product produced by this process.

Ultrasound imaging devices have become an important part of medical technology. The most commonly familiar applications for these devices are fetal imaging and cardiac imaging. The transceiver of an ultrasound imaging system is typically housed in a probe that is placed over a portion of the imaging subject's body. The transceiver typically includes an array of piezoelectric elements, for producing the ultrasonic waves, supported on some type of backing structure. Two basic approaches that have been proposed are 1) to cast an epoxy loaded with acoustic absorbing and scattering material in place as a liquid on an array surface or 2) to cast the backing structure separately and to attach it to the array.

For the case of a one-dimensional array, the necessary electrical connections can be made from the side. For a two-dimensional ultrasound transceiver array (a "2-D array"), however, the electrical connections are typically routed through the backing structure. The backing structure is, in turn, connected to a connective media such as a flex circuit that electrically connects each piezoelectric element to a driver and receiver. The difficulty of connecting each piezoelectric element to a connective media through the backing array has been a particularly vexing problem confronting those attempting to construct a 2-D array.

Ideally, a backing structure for a 2-D array should perform four essential functions that are potentially in conflict. First, the backing structure should support the array of piezoelectric elements with sufficient rigidity that the elements are not flexed into each other by the application of pressure to the array. Second, the backing structure should acoustically isolate the elements from one another. Third, the backing structure should electrically isolate the elements from one another. Finally, the backing structure should electrically connect each piezoelectric element to a connective media electrode.

One proposed approach to addressing these performance issues is to interpose a prior art resilient, acoustically absorbing, anisotropically electrically conducting layer between an array of electrodes and an array of piezoelectric elements. In conventional interconnect applications, this layer is constructed of some resilient substance (typically silicone) having a multiplicity of fine conducting wires (typical diameter of about 25 $\mu$m or larger connecting the top and bottom major surface of the layer.

Unfortunately, silicone is not sufficiently acoustically absorbent to perform well in a backing structure application. Additionally, the conductor pitch of currently available anisotropic layers is on the order of 300 $\mu$m, insufficient to form uniform connections with an ultrasound array having a pitch on the order of 300 $\mu$m (to form uniform connections the conductor pitch should be one half the element pitch, or about 150 $\mu$m). Moreover, the silicone used in anisotropic layers lacks sufficient rigidity to support the elements of a transceiving array in proper alignment.

There is, moreover, a general problem of forming adequate and uniform electrical connections with this type of layer, especially as, through a prospective course of technological development, ultrasound transceiver elements are reduced in size. The wires used in prior art anisotropic material are so fine that each individual wire presents a non-negligible resistance to the electrical signals sent to the elements and produced by the elements. Hence, an element that contacts more fine wires will have a lower conductivity connection with its corresponding connective media electrode. This has the potential for introducing aliasing and/or random unevenness into the electrical transmission through the anisotropic layer.

A number of different approaches have been proposed for a 2-D array backing structure. In U.S. Pat. No. 5,644,085 a method is described in which a substrate is machined to form a multiplicity of vias. The substrate is then coated with conductive material, to form plated vias, and connected with a block of piezoelectric material. The piezoelectric material is machined to form elements, with the kerfs separating the elements machined into the substrate. With this method the bottom of each piezoelectric element is connected with a number of plated vias. Unfortunately, no technique is shown for connecting the top of each element to a ground connector. Although it would be possible to connect each piezoelectric element top to a ground plane (a sheet of conductive material), this solution is not acoustically optimal. Moreover, the great multiplicity of vias shown in the figures will tend to negate the acoustic absorptiveness of the substrate material. Furthermore, the randomness of this type of approach has the potential to introduce a lack of uniformity into the conductivity of the connections formed and the acoustic properties of the backing layer.

Miller et al. U.S. Pat. No. 5,267,221, Greenstein et al. U.S. Pat. No. 5,592,730, and Kunkel, III, U.S. Pat. No. 5,648,942, all appear to show backing layers built up through additive techniques where conductive wires or elements are positively interspersed with acoustically absorbing material. The principal problem with this type of technique is achieving the smallness of scale (@300 $\mu$m×300 $\mu$m elements, or smaller) typically desired for two dimensional arrays. Because of this, there is a problem of forming adequate and uniform electrical connections with this type of layer, especially as, through a prospective course of technological development, ultrasound transceiver elements are reduced in size. Furthermore, it would be difficult constructing a backing structure where all of the conductive elements are properly positioned to align with transceiver elements, using the cumbersome additive construction techniques disclosed.

What is needed but is not yet available is a method of producing an ultrasound array backing structure that is acoustically absorptive and that ensures an electrical connection between each piezoelectric element and its corresponding electrode that has an insignificant electrical resistance while maintaining sufficient acoustic isolation between elements.

SUMMARY OF THE INVENTION

The present invention is a method of producing a backing structure for an ultrasound transceiver. The method begins with a substrate of acoustically absorbent electrically resistive material having a first and a second major surface. The substrate is laser machined to produce a set of vias. Next, the substrate is plated with an electrically conductive material, thereby forming plated vias and exterior surfaces. Then, excess electrically conductive material is removed from the substrate to leave a set of conductive pads on the first major surface for permitting electrical connection to an array of piezoelectric ultrasound elements and a set of conductive pads on the second major surface for permitting connection to an array of connective media electrodes. The plated vias electrically connect the two sets of conductive pads.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1A:
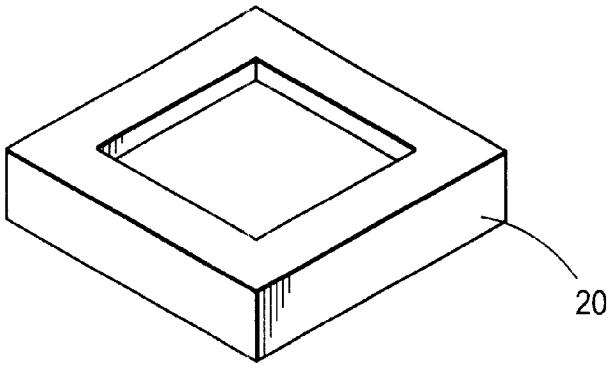
FIG. 1*a* is an isometric drawing of an exemplary mold for forming an insulative substrate for a backing structure according to the present invention.
Figure 1B:
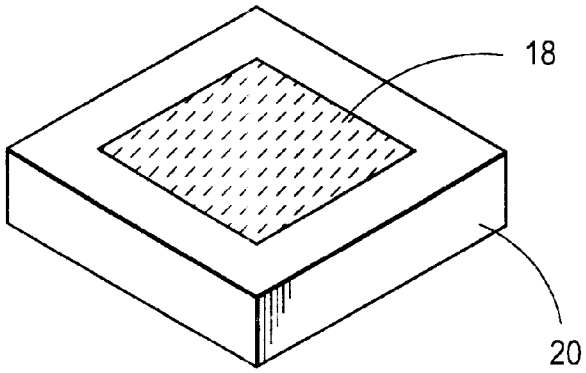
FIG. 1*b* is an isometric drawing of the mold of FIG. 1*a* filled with material for forming an insulative substrate for a backing structure according to the present invention.
Figure 1C:
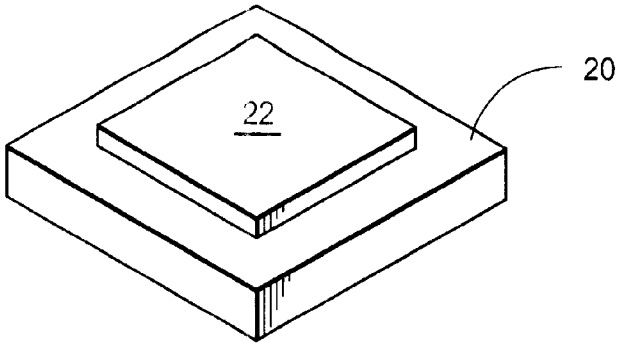
FIG. 1*c* is an isometric drawing of the mold of FIG. 1*a* with a conformal lid for forming an insulative substrate for a backing structure according to the present invention.
Figure 1D:
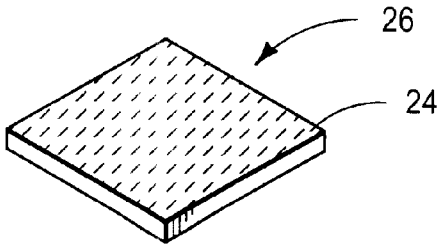
FIG. 1*d* is an isometric drawing of an insulative substrate taken from the aforementioned mold for a backing structure according to the present invention.

Referring to FIGS. 1*a*–1*d*, a substrate 24 of acoustically absorbent, electrically resistive material is formed by first creating particles composed of a mixture of room temperature vulcanizing (RTV) rubber and metal powder. These particles are mixed into an epoxy casting medium, together with additional metal to raise the density and thus the acoustic impedance. The mixture of particles and epoxy casting medium 18 are poured into a casting block 20, cured while being constrained a conformal lid 22 and removed from block 20 to form an insulative substrate 24 which is used as a work piece 26. The exact materials and composition of substrate 24 differ according to the desired final properties of substrate 24, according to principles well known to skilled persons.

Figure 2A:
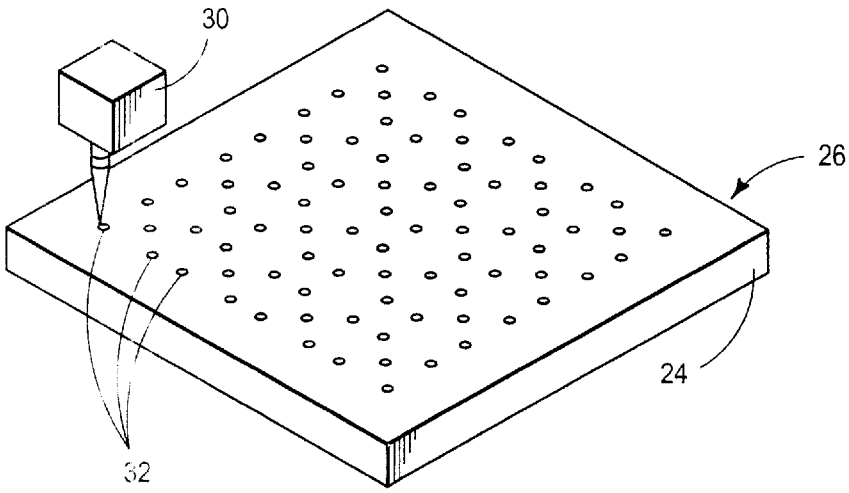
FIG. 2*a* is an isometric drawing of the insulative substrate of FIG. 1*d* being machined by a laser for forming a backing structure according to the present invention. As in all of the subsequent figures, the machined features are shown in an exaggerated size for clarity of presentation.
Figure 2B:
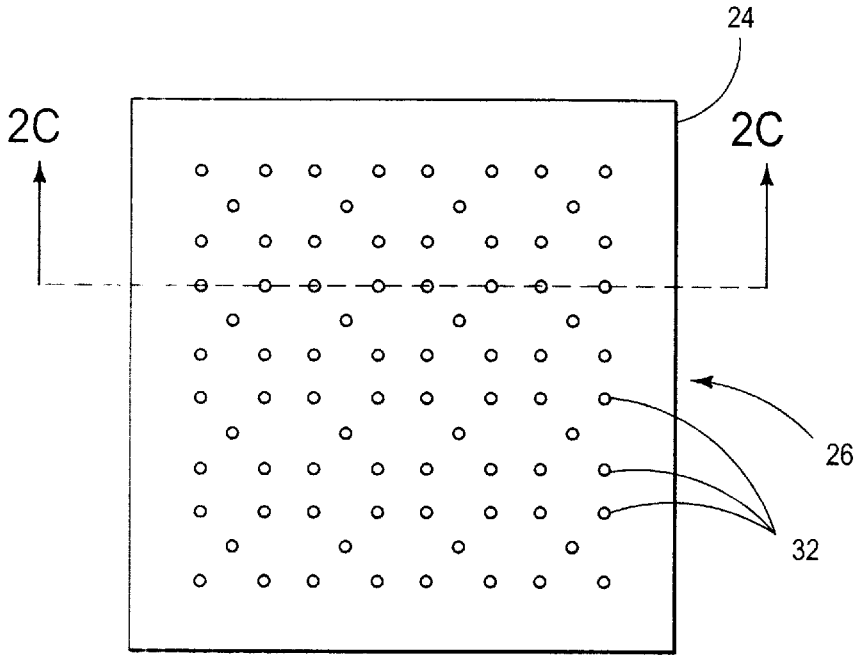
FIG. 2*b* is a top view of the insulative substrate of FIG. 2*a*.
Figure 2C:
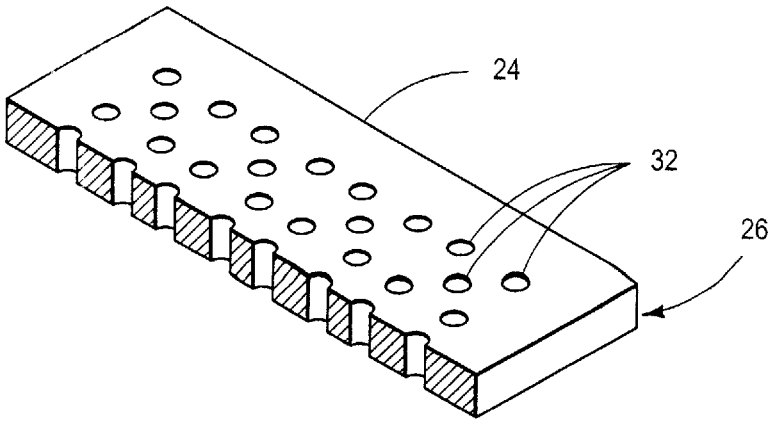
FIG. 2*c* is a cut-away isometric view, taken along line 2*c*–2*c* of FIG. 2*b*, of the insulative substrate of FIG. 2*a*.

In the next step, illustrated in FIGS. 2*a*–2*c*, a laser 30, is used to drill a multiplicity of vias 32 through substrate 24. In an alternative preferred embodiment, shown in FIGS. 3*a*–3*d*, a multiplicity of indented signal pad seats 33 and indented circular ground pad seats 37 are also formed, defining a set of elevated areas 35. The pad seats and vias are preferably arranged in four-element sets with circular ground pad seat 37 for grounding four piezoelectric elements surrounded by four signal pad seats 32, one for each of the four elements grounded by the pad that will fit into pad seat 37 (see below).

A frequency multiplied (e.g. tripled or quadrupled) nd:YAG laser, may be used for the laser machining steps. Then, as shown in FIGS. 4*a*–4*d*, conductive metal is deposited onto substrate 24, thereby creating plated vias 32' and an exterior plating 34. The conductive metal is typically deposited through plasma deposition (also referred to as "sputtering"), electrolysis, electroless plating or some combination of these techniques.

Figure 5A:
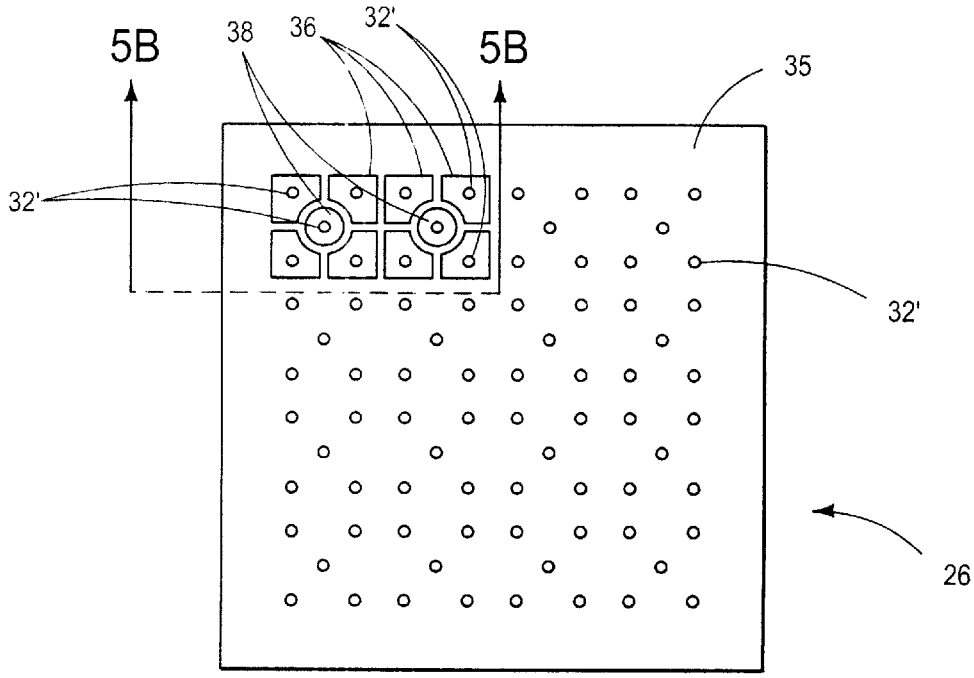
FIG. 5*a* is a top view of the insulative substrate of FIG. 4*a* that has been partially processed to separate the conductive plating into an array of conductive pads.
Figure 5B:
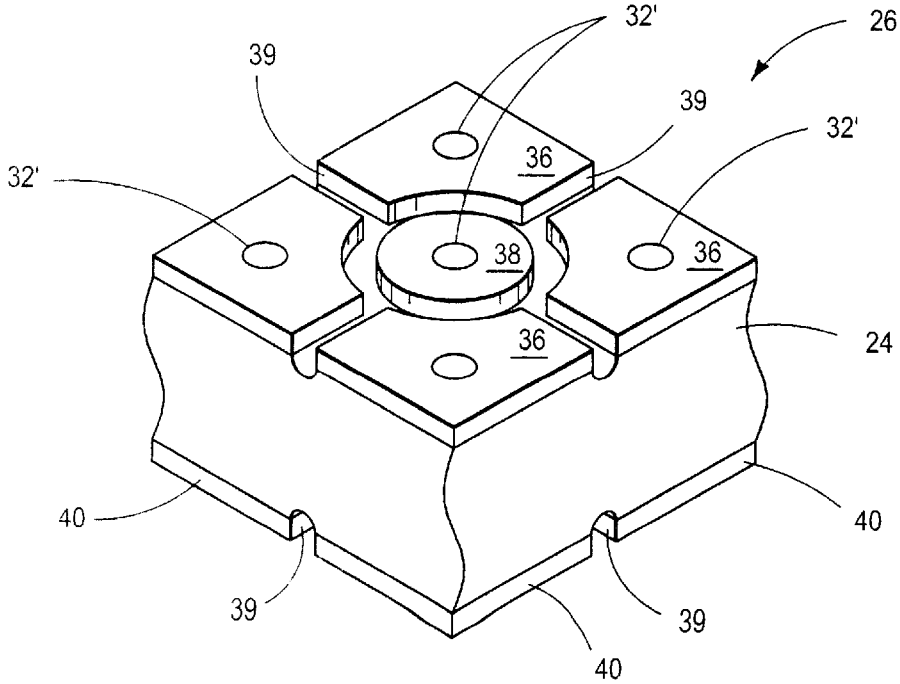
FIG. 5*b* is a cut-away isometric view of a four-element pad set of the insulative substrate of FIG. 5*a*.

Referring to FIGS. 5*a* and 5*b*, exterior plating is divided into a set of connective media contacting signal pads 36 and a set of circular ground pads 38 and a set of transceiver element contacting signal pads 40 and transceiver element contacting ground pads 68.

Figure 3A:
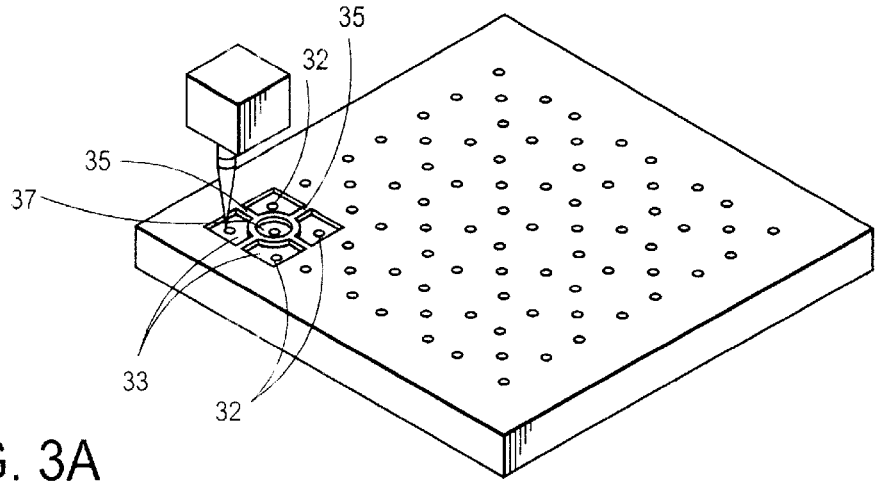
FIG. 3*a* is an isometric drawing of the insulative substrate of FIG. 1*d* being machined by a laser for forming a backing structure according to an alternative preferred embodiment of the present invention.
Figure 3B:
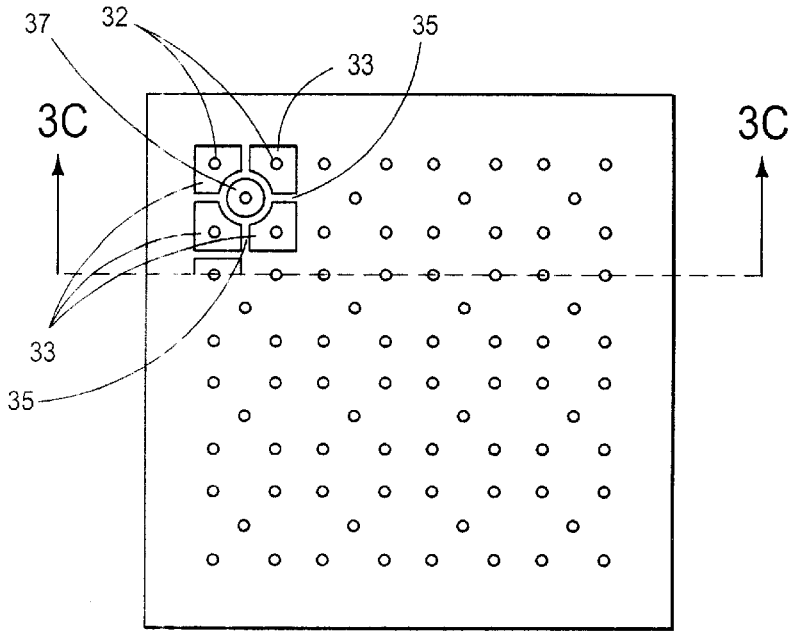
FIG. 3*b* is a top view of the insulative substrate of FIG. 3*a*.
Figure 3C:
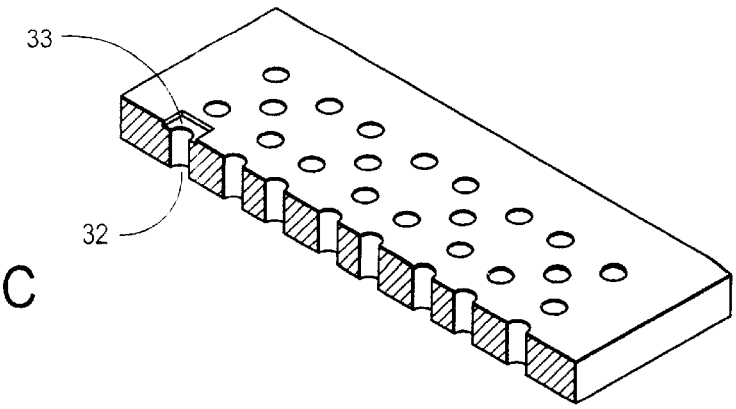
FIG. 3*c* is a cut-away isometric view, taken along line 3*c*–3*c* of FIG. 3*b*, of the insulative substrate of FIG. 3*a*.
Figure 4A:
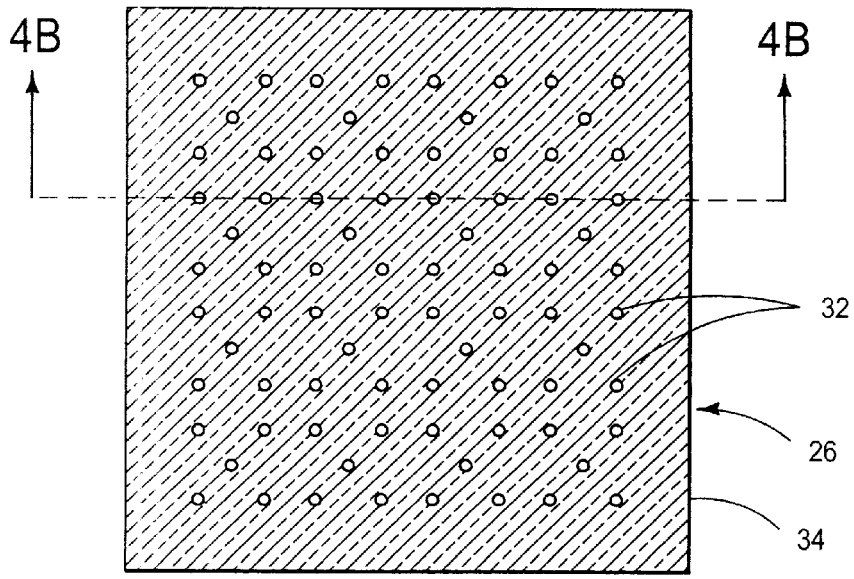
FIG. 4*a* is a top view of the insulative substrate of FIG. 2*a* that has been plated with metal for forming a backing structure according to the present invention. As in all of the subsequent figures, the plating is shown in an exaggerated scale for clarity of presentation.
Figure 4B:
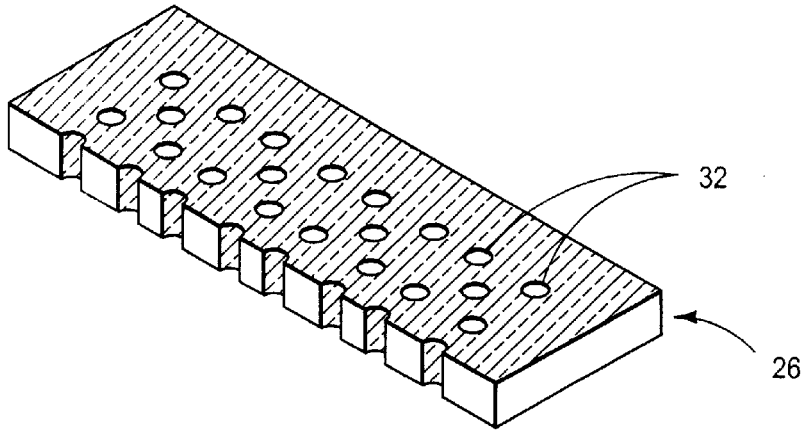
FIG. 4*b* is a cut-away isometric view of the insulative substrate of FIG. 4*a* taken along line 4*b*–4*b* of FIG. 4*a*.
Figure 4C:
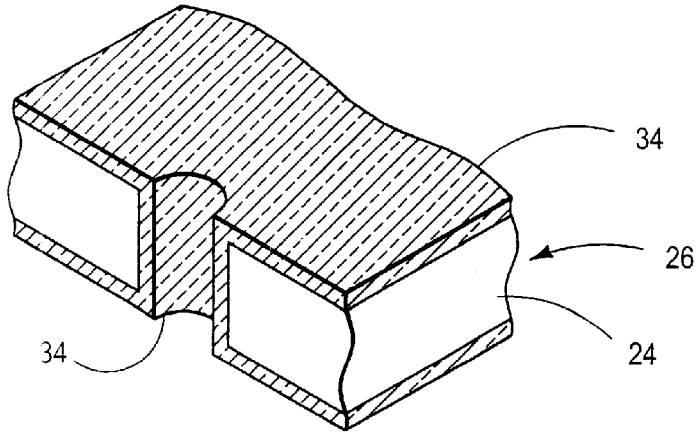
FIG. 4*c* is an expanded cut-away isometric view of a single-plated via of the workpiece of FIG. 4*b*.
Figure 4D:
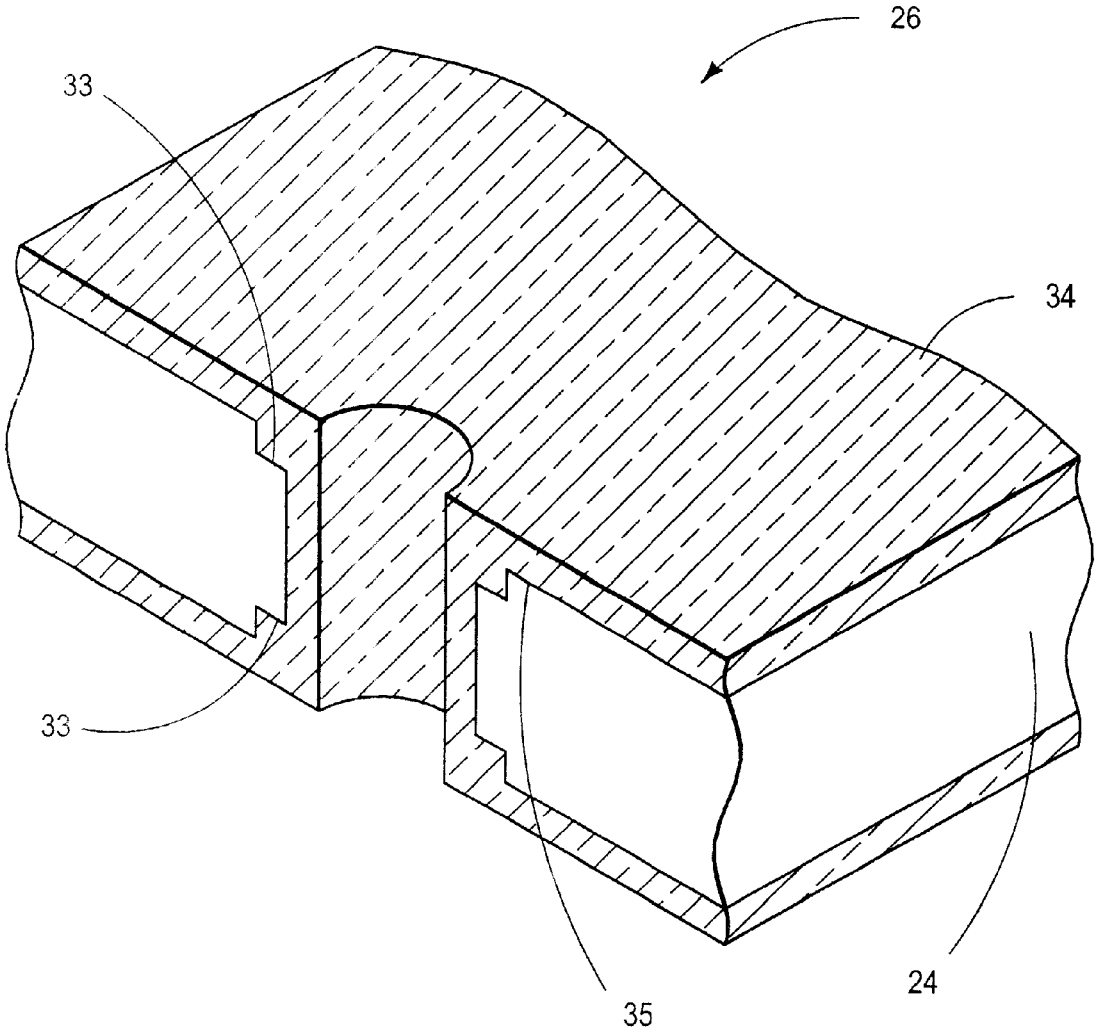
FIG. 4*d* is a cut-away isometric view of a single-plated via of the workpiece of FIG. 3*c* that has been plated with conductive material for forming a backing structure according to an alternative preferred embodiment of the present invention.
Figure 5C:
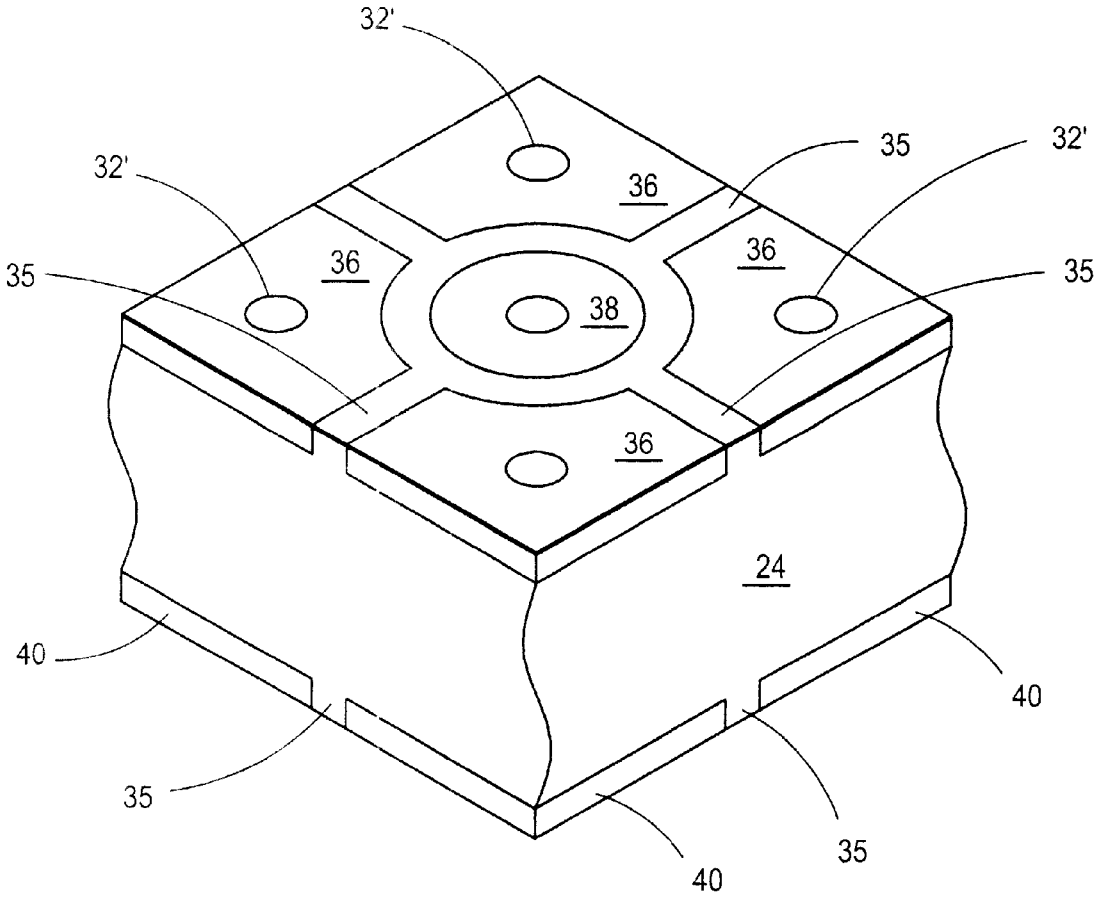
FIG. 5*c* is a cut-away isometric view of a four-element pad set of the insulative substrate of FIG. 4*d* in which a portion of the metal plating has been removed to produce conductive pads according to an alternative preferred embodiment of the present invention.
Figure 6A:
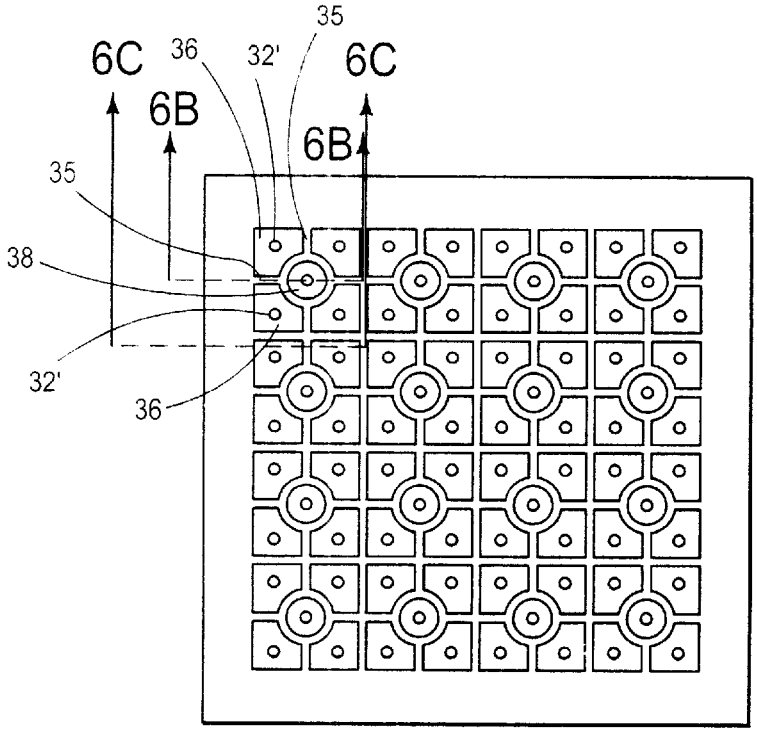
FIG. 6*a* is a top view of the backing structure of the present invention connected with an ultrasound transceiver array (not visible).
Figure 6B:
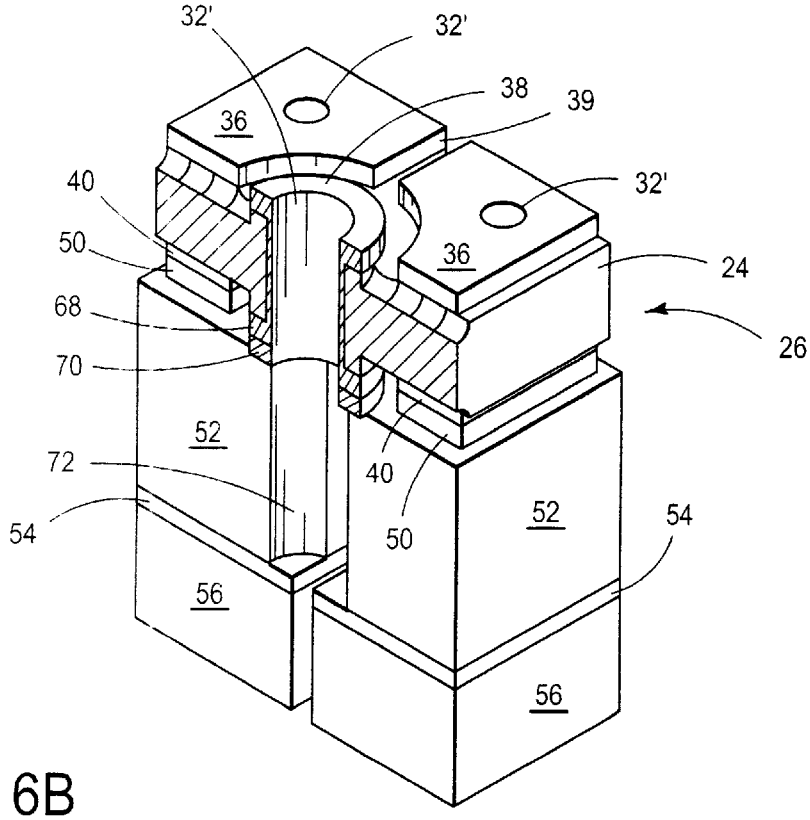
FIG. 6*b* is a cut-away isometric view of a partial four-element pad set of the backing structure and ultrasound transceiver array of FIG. 6*a*, taken along, cut away along line 6*b*–6*b*.
Figure 6C:
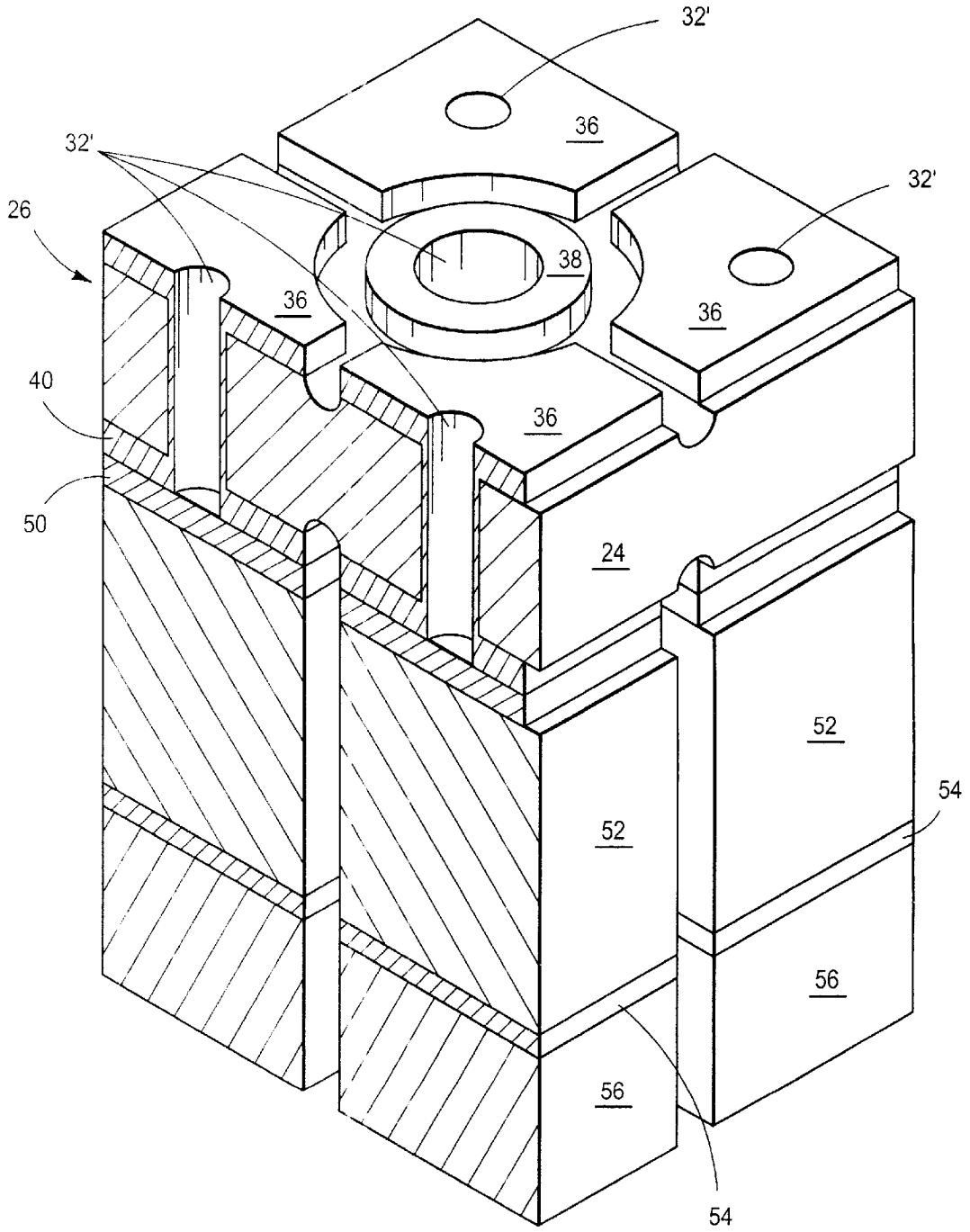
FIG. 6*c* is a cross-sectional view of a four-element pad set of the backing structure and array of FIG. 6, taken along line 6*c*–6*c*.
Figure 7:
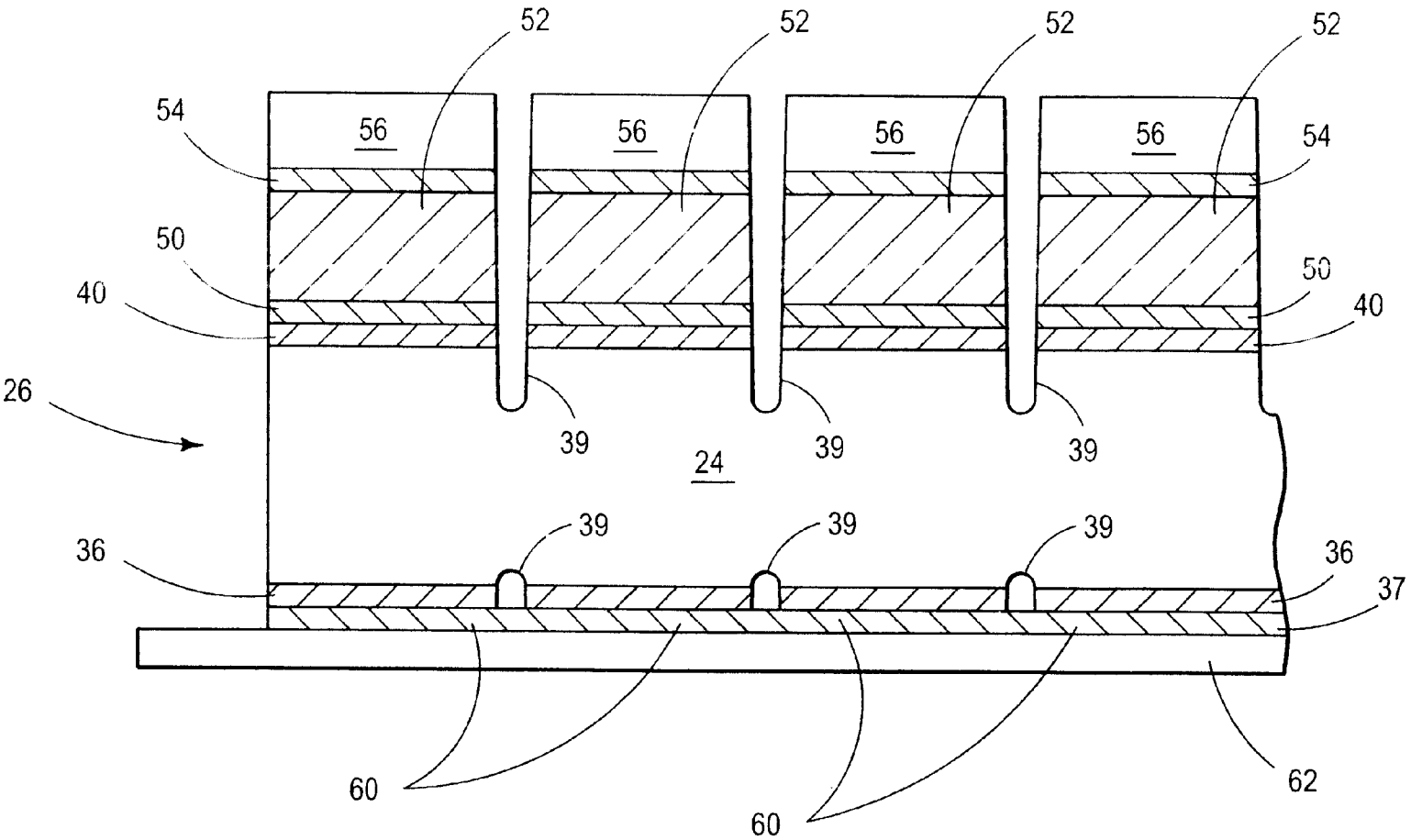
FIG. 7 is a cross-sectional view taken along line 7—7 of FIG. 5*a* of a completed backing structure produced according to the present invention, connected with an array of piezoelectric elements.

The step corresponding to FIGS. 4*a*–4*c* for the alternative preferred embodiment of FIGS. 3*a*–3*c* is shown in FIG. 4*d*. In this embodiment signal pads 36 and ground pads 38 are formed by lapping down exterior plating 34 to expose elevated areas 35, which separate indented pad seats 33 and 37 to form signal pads 36 and ground pads 38 respectively (result shown in FIG. 5*c*). Whether or not indented pad seats 33 have been formed, pads 36 and 38 may be formed by a patterned removal of exterior plating 34, either through photolithography or laser machining to form dividing trenches 39 (result shown in FIGS. 5*a* and 5*b*).

Finally, as shown in FIGS. 6*a*–6*c* and 7, the now finished backing structure workpiece 26 is aligned with and interposed between an array of transceiving elements 48, each including a signal electrodes 50, a piezoelectric element 52, a ground electrode 54 and a matching layer 56; and a flex circuit 60 having an array of flex circuit electrodes 62. This type of array and its construction is detailed in U.S. patent application Ser. No. 08/738,611, filed Oct. 28, 1996, and entitled ULTRASOUND TRANSCEIVER AND METHOD FOR PRODUCING SAME, which is assigned to the same assignee as the present application and is incorporated by reference as if fully set forth herein. As shown, electrodes 50 contact electrodes 40 and electrodes 36 contact electrodes 60. In addition, ground conductive pads 68 of backing structure 26 are connected to corresponding ground electrodes 70 of array 48. Ground layer 54 is connected to ground electrode 70 by plated via segment 72. Array of transceiving elements 48 is typically partially machined to define transceiving elements 48 prior to being attached to backing structure 26 and machined to finally separate elements 48 after being attached to backing structure 26, as backing structure 26 is what holds array 48 together. Fiducial markings or apertures are used to align backing structure 26 and array 48, typically by use of a laser beam directed through matching fiducial apertures.

The method of the present invention provides many advantage over the prior art. First, the precision of laser machining permits the precise construction a backing structure for an acoustic array that is precisely constructed on a small scale. The acoustic array and the backing structure may be aligned through fiducial markings and precisely connected together.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of producing an acoustically absorbing electrically conducting backing structure and piezoelectric transceiving elements for an ultrasound transceiver, comprising the steps of:

(a) providing a substrate of acoustically absorbent, electrically resistive material, said substrate having a first major surface and a second major surface opposed to said first major surface;

(b) directing a laser at said first major surface and laser machining a set of through-hole vias through said substrate to said second major surface, said through-hole vias being distributed over two dimensions;

(c) plating said substrate with an electronically conductive material to form a plated substrate having electrically conductive plated vias, extending from said first major surface to said second major surface; and (d) removing excess electrically conductive material from said plated substrate to leave a pattern of electrically conductive pads on said substrate selectively connected to said electrically conductive plated vias, thereby producing said backing structure;

wherein said pattern of electrically conductive pads is a two-dimensional pattern of conductive pads and further including the additional steps of:

(e) providing a partially formed two dimensional array of piezoelectric transceiving elements, separated by a set of intersecting kerfs, each element having a ground electrode and a signal electrode; and (b) attaching said partially formed two dimensional array of piezoelectric transceiving elements to said backing structure.

2. The method of claim 1 wherein step (b) further includes laser machining a set of indented pad seats and wherein said conductive pads are formed on said indented pad seats.

3. The method of claim 2 wherein said step of removing excess electrically conductive material from said plated substrate more specifically comprises using metallurgical sectioning methods to polish the plated substrate, thereby removing said excess electrically conductive material.

4. The method of claim 1 wherein step (d) more specifically comprises using photolithography to remove said excess material.

5. The method of claim 1 wherein step (d) more specifically comprises laser ablating said excess material.

6. The method of claim 1, wherein step (b) more specifically includes machining said set of vias so that, for each said conductive pad of step (d), there are a predetermined number of vias in a predetermined location with respect to the prospective location of said each said conductive pad.

7. The method of claim 6 wherein said predetermined number of vias is no greater than 4.

8. The method of claim 1, further including, subsequent to step (b), the step of machining said kerfs of said partially formed two dimensional array of piezoelectric transceiving elements until said kerfs extend entirely through said piezoelectric material to finally separate said elements of said array of piezoelectric material.

9. The method of claim 8, wherein said step of machining said partially formed two dimensional array of piezoelectric transceiving elements further includes machining into said backing layer through said kerfs to extend said kerfs into said backing structure to further acoustically isolate said piezoelectric elements from one another.

10. The method of claim 1, more specifically and further includes forming ground conductive pads positioned to attach to said ground electrodes and signal conductive pads positioned to connect to said signal electrodes.

11. The method of claim 1 wherein said step of providing the substrate of acoustically absorbent, electrically resistive material more specifically comprises creating a substrate by casting absorbent materials into an epoxy based liquid.

12. The method of claim 1 wherein step of laser machining is performed by an ultraviolet laser.

* * * * *